United States Patent [19]

Miller

[11] 4,015,783

[45] Apr. 5, 1977

[54] REVERSIBLE GRATE BAR AND SUPPORT FOR CRUSHERS

[75] Inventor: Donald G. Miller, Glendale, Mo.

[73] Assignee: American Pulverizer Company, St. Louis, Mo.

[22] Filed: July 10, 1975

[21] Appl. No.: 594,777

[52] U.S. Cl. ..... 241/73; 241/89.3; 241/285 R; 241/299

[51] Int. Cl.² ..... B02C 23/10

[58] Field of Search ..... 241/73, 86, 86.1, 86.2, 241/89.1, 89.2, 89.3, 89.4, 95, 182, 183, 285 R, 299

[56] References Cited

UNITED STATES PATENTS

| | | | |
|---|---|---|---|
| 1,309,805 | 7/1919 | Lincoln | 241/73 |
| 1,746,512 | 2/1930 | Anderson | 241/299 X |
| 3,465,973 | 9/1969 | Williams | 241/86.2 |
| 3,722,805 | 3/1973 | Strom | 241/73 |
| 3,891,152 | 6/1975 | Gaugenheimer | 241/73 X |

*Primary Examiner*—Roy Lake
*Assistant Examiner*—Howard N. Goldberg
*Attorney, Agent, or Firm*—Paul M. Denk

[57] ABSTRACT

In a hammer mill or crusher for use in size reduction or even pulverizing rock, metals, or other materials, a rotating crusher and a contiguous surface are confined between opposing side walls and an inlet and discharge for the mill, with each side wall having supports designed for accommodating the arcuate formation of the crushing surface; a series of reversible grate bars span the distance between the side walls and associate at each end a structural shoe designed for stably positioning of each bar into the formed surface. Each grate bar and its end shoes are contoured on their sides to provide for their mating with adjacent bars and shoes when arranged into the crusher surface.

14 Claims, 10 Drawing Figures

REVERSIBLE GRATE BAR AND SUPPORT FOR CRUSHERS

BACKGROUND OF THE INVENTION

This invention relates generally to hammer mills, and more particularly pertains to the formation of the crushing surface from a series of adjacently arranged reversible grate bars that provide greatly extended usage of the apparatus.

Hammer mills and crushing machinery have long been utilized as the means for reducing the size of various types of ores, rock, and even what would generally have been considered as waste material in industrial operation such as metal turnings, and related by-products. As is well known, the principle of operation of such machinery is to rotatably dispose a plurality of hammers or the like within the structured machinery and to provide for their turning into close proximity with a reinforced surface to provide the impacting forces sufficient to cause breakage in the size of the material being treated. Obviously, the magnitude of the impacting force that is generated between the rotating hammer and the contiguous crushing surface can be quite enormous thereby requiring that not only must the hammers be constructed of high strength materials, but that the crushing surface itself must be able to withstand the impact of equivalent pressures. Furthermore, the continuous impingement of the hammers against materials lying on the crushing surface causes significant friction that eventually through wear, if not fracture, deteriorates the condition of the crushing surface to the extent that the setting of the hammers with respect to the surface become increased thereby causing disparity in the size of the crushed material desired to be acquired from the apparatus.

To overcome the foregoing type of problem, either a new crushing surface must periodically be installed into the apparatus, replacing the old and worn one, or the surface itself must be reversed in its positioning so as to expose a new surface thereby attaining a double advantage from a single surface structure. This feature of attaining at least two operative surfaces from the crushing surface of such machinery is not new, and as can be seen from the United States patent to Anderson, U.S. Pat. No. 1,746,512, reversible type screen bars were shown for forming the screen of the disclosed crushing machinery. As can be seen, the individual narrow bars extend between the supporting portions of the crusher, having their end projections extending within said portions for support. While there is usefulness in being able to reverse the screen bar of the type shown, one drawback is that the shown bars do not have any substantial width due to the fact that the end projections had to be of a narrowing width to provide for their accommodation within the curved supporting portions of the shown cage. As a result, the strength of such bars was significantly reduced, and the bars would succumb to frequent fracture when exposed to the impacting forces of the heavy rotating type of hammers as indicated.

Efforts have been made to rectify the problems associated with the utilization of the narrow type of screens or bars as previously shown in the prior art, and the United States patent to Williams, U.S. Pat. No. 3,465,973, discloses a wider and more structurally sound type of cage bar that contains the advantages of being reversible, and which mounts to supporting structure provided along each end wall. As can be seen from this particular invention, one problem with its operating ability is in the style of mounts used to support the bar at its ends. As shown, various styles of abutment means, wedging elements, liners, and bolts are required to furnish stable support for the depicted cage bar in place. While such mounting structure may be theoretically useful for its intended purpose, in practice, the tremendous forces of impact caused by the rotating hammers when encountering the treated materials exert pressure against such piecemeal assembled type of mounting structure, which forces can either cause fracture to its various components, or at least, due to its jarring impact, cause their loosening, with the concurrent looseness of the cage bar itself in its position within the crusher surface.

To overcome the problems encountered with the utilization of multi-component mounts for holding crusher bars within its formed surface, the herein disclosed invention utilizes a single mounting means in the form of a shoe, one of each which cooperates with the ends of the grate bar, for providing its stable support between the side walls of a hammer mill. The use of such support was given some consideration in the past, not for use in support of reversible grate bars, but rather, and as shown in the United States patent to Bonarrigo, U.S. Pat. No. 3,617,007, for application in holding upper and lower grate sections together, with the upper section interlocking within a lower supporting section. Then, as its upper grate wears out, it must be replaced in the assembly. The most apparent problems associated with this style of grate bar assembly would appear to be twofold, one that it requires a new cast upper grate section each time such a bar is to be replaced, and secondly, the style of support as is provided through its lower grate section is not designed for accommodating a reversible style of grate bar.

In view of the foregoing, it is the principal object of the present invention to provide reversible grate bars for use in the assembly of a surface for a crusher and which are stably mounted into such a configuration through the use of a minimum of supporting components.

A further object of this invention is to provide a reversible grate bar with accompanying end shoes that are complemental in formation so as to provide for their stable and abutting support when assembled into the formation of a crushing surface.

A further object of this invention is to provide a structurally formed grate bar and its supportive end shoes that are properly contoured so as to provide for their mating relationship into a contiguous relationship when assembled into the formation of a crusher surface.

A further object of this invention is to provide a grate bar which is reversible and is supported at each end within a hammer mill through the use of a single structural member.

An additional object of this invention is the provision of a grate bar that is so contoured as to provide for its tight retention intermediate the end supports of a hammer mill.

These and other objects will become more apparent to those skilled in the art upon reviewing the summary of this invention and in view of the description of its preferred embodiment when read in light of its drawings.

SUMMARY OF THE INVENTION

This invention contemplates the formation of a crushing surface within a hammer mill or crusher machinery, and which surface is formed from a plurality of adjacently arranged reversible grate bars that are supported at each end through the agency of a single supportive structural shoe. The shoe and the extended end portions of each grate bar are complemental in their fitting together, which provides for their snug and non-loosened confinement together, and which combination then fits intermediate the lower side liner and the grate bar support customarily found within a hammer mill, in a close confining relationship, thereby preventing any looseness or vibration in the surface as formed. The sides of each set of reversible grate bar and its end shoes are conveniently contoured so as to provide for their contiguous mating against adjacent like grate bar assemblies when formed and arranged into the curvature of the crushing surface. Hence, the fabrication of such a surface can be easy and conveniently made by simply sliding each grate bar and its accompanying end shoes into the position intermediate the mill side supports, until sufficient grate bars are adjacently arranged into an abutting relationship and the formation of such a surface, with the further advantage that no particular grate bar on its end shoes need be further secured in place, as through use of any form of fastening means such as tightening bolts, as had previously been required in prior art machinery, as earlier described. In addition, the removal of any particular grate bar from the formed surface can once again conveniently be achieved by simply retracting the bar and its end shoes from within the guide ways of the side supports. The grate bar, due to its reversible characteristics, can be turned for arrangement in at least four different directions and provide for its repeated usage within the crushing surface, so that as abrasive forces may cause pitting or wear along any particular edge of the grate bar apertures, ends, or edges, the bar may be conveniently turned so as to dispose such worn edges reversely from its previous positioning within the crusher surface.

DESCRIPTION OF THE PREFERRED EMBODIMENT

Figure 1:
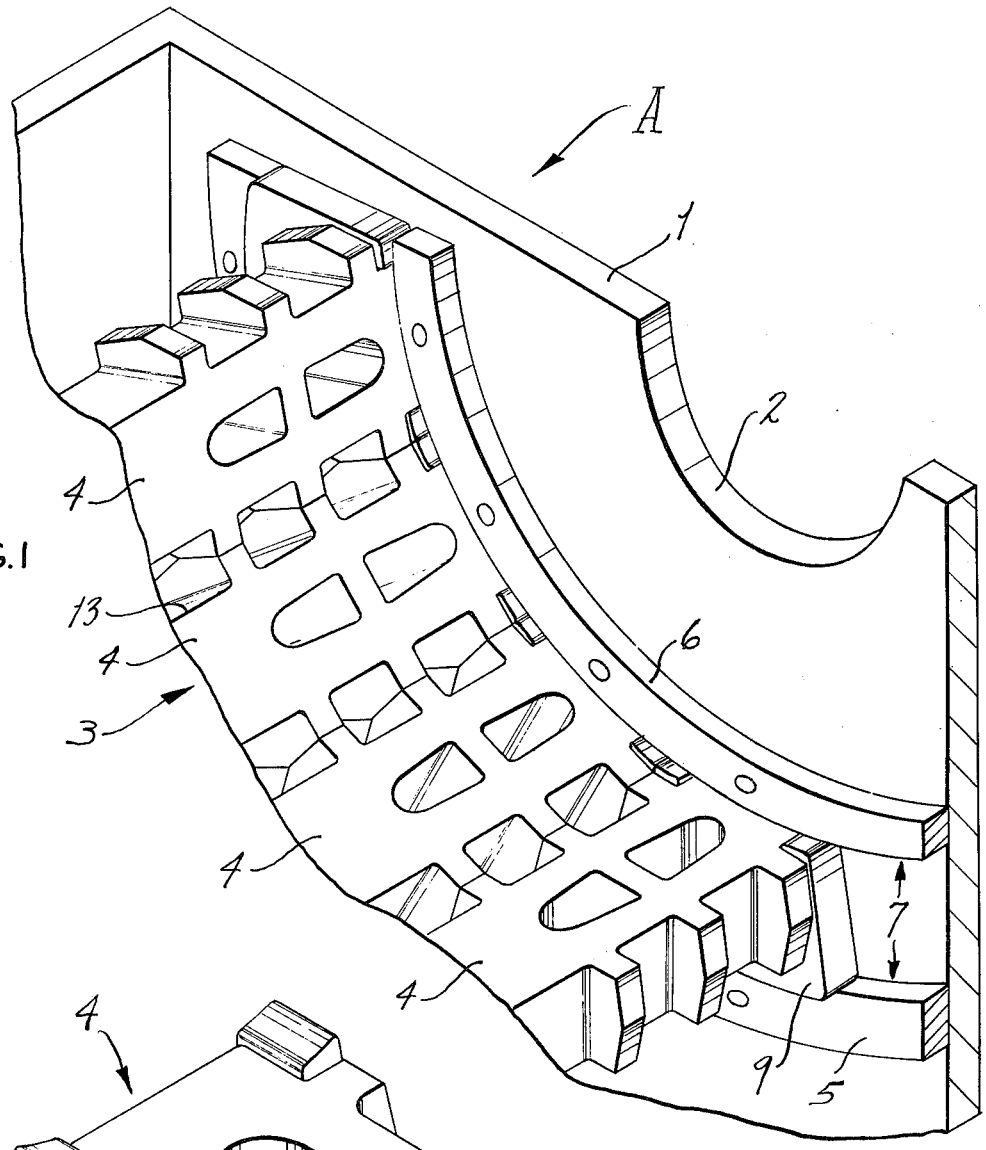
FIG. 1 provides a fragmentary view of a series of the reversible grate bars of this invention and their accompanying end shoes held in place by the side supports provided along a wall of a crusher.
Figure 2:
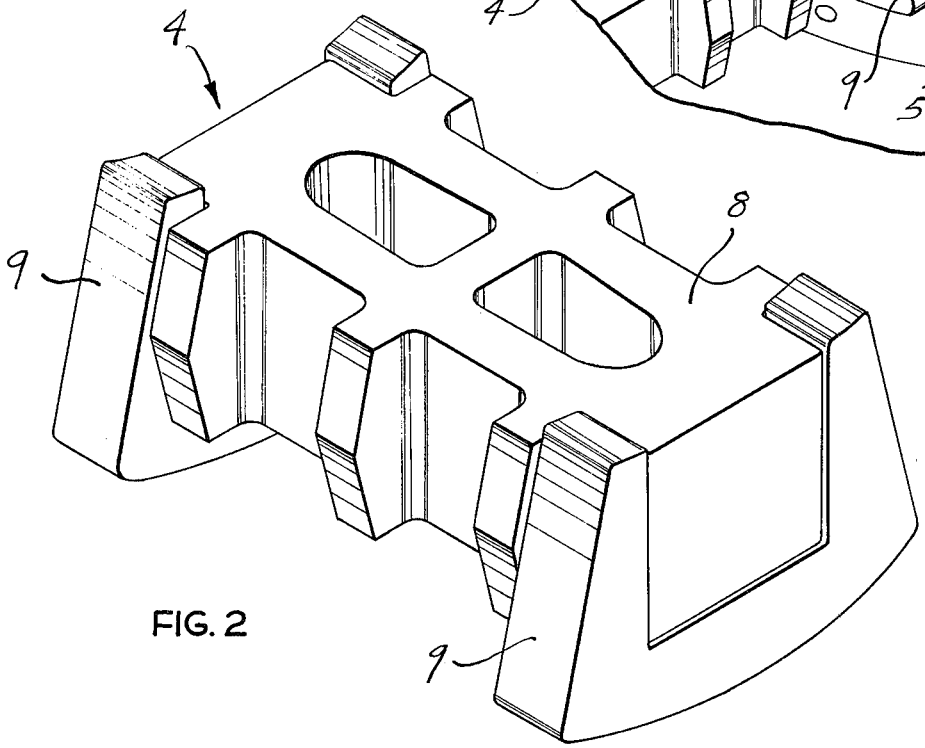
FIG. 2 provides a perspective view of one reversible grate bar assembly with its end shoes as readied for installation into the formation of a crushing surface within a hammer mill.

In the preferred embodiment, and particularly as shown in FIGS. 1 and 2, a part of the crusher A is depicted by disclosing a segment of a lower side housing 1 of the usual style that incorporates a semi-circular opening, as at 2, through which the usual series of hammers (not shown) are mounted upon a main shaft and turned in proximity with the crusher surface 3 made up of a series of the reversible grate bar assemblies 4 of this invention. In such a crusher, which is also commonly referred in the trade as a hammer mill, there is usually incorporated some form of a grate bar support 5 that is arcuately disposed for supporting the curvature of the crushing surface 3 in a fixed distance with respect to the rotating hammers of the mill. To further support the surface 3 of the crusher in place, and to insure its stability and vibration free maintenance, a lower side liner 6 is also provided arcuately arranged for embracing, or to be maintained in contiguity, with the upper end surfaces of the grate bars of the fabricated crushing surface. As is the common practice, this lower side liner or the grate bar support are rigidly fixed to the housing 1 in a manner that provides for a spacing, as at 7, intermediate thereof, and which allows for the sliding emplacement of the reversible grate bars into position for forming the crushing surface of the hammer mill.

Each reversible grate bar assembly 4 is more visually shown in FIG. 2, and it comprises a reversible grate bar 8 which is embraced at either end by a structured shoe 9, which as can also be seen from FIG. 1, said shoes provide the instrumentalities for securely bracing its respective grate bar intermediate the support 5 and the liner 6.

Figure 3:
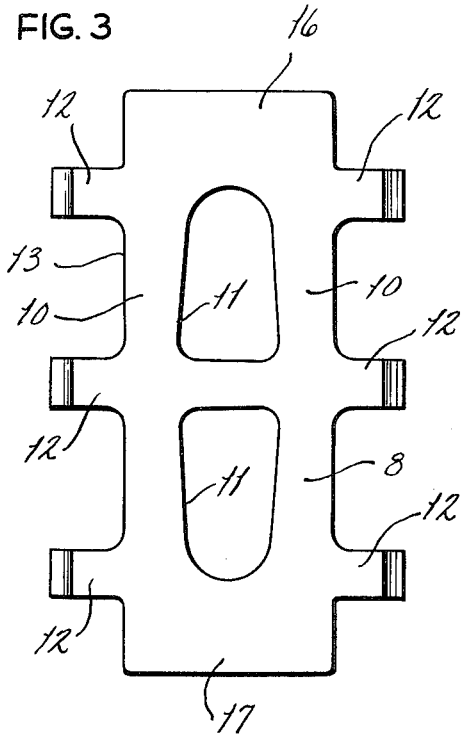
FIG. 3 provides a top view of a reversible grate bar of this invention.
Figure 5:
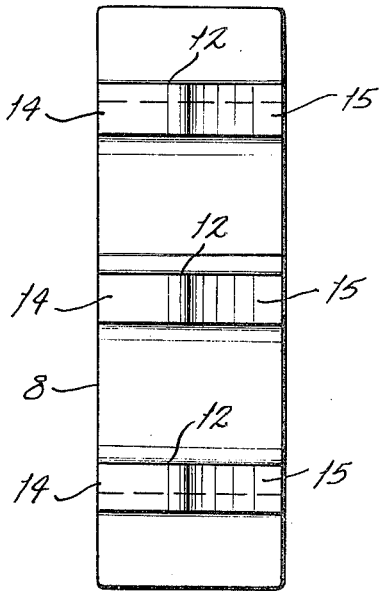
FIG. 5 provides a side view of a reversible grate bar of this invention.
Figure 4:
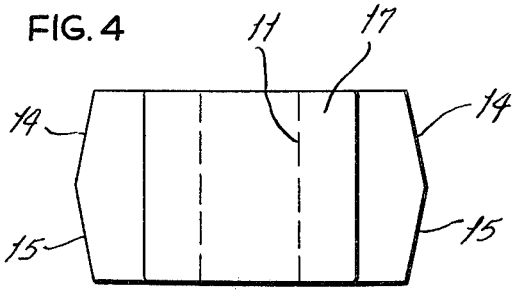
FIG. 4 provides an end view of a reversible grate bar as shown in FIG. 2, with its end shoe removed.

By also referring to FIGS. 3 through 5, each reversible grate bar 8 is provided with an upper and lower surface which are mirror images of each other, so that as one particular surface may become deteriorated due to abrasive wear as through prolonged usage and exposure to the operations of the hammers, the grate bar may be either reversed upside down or turned around, so as to dispose a different surface to the impacting forces of the hammers acting upon the materials being crushed. The ability of the reversible grate bar to be turned either end for end and/or upside down actually provides a fourfold usage for each grate bar of this invention. A further advantage of this style of grate bar as shown in these figures is their structural soundness due to their having increased widths in the formation of the cast bar. For example, each grate bar 8 is provided with at least a pair of structural segments 10 that extend the full length of the grate bar, and which are integrally cast. together into a unified structure as shown. In this formation, each bar is provided with one or more apertures, as at 11, which have dimensions approximating the size of the crushed segments desired from the hammer mill, and which apertures act in the nature of a screening means that allows only particles smaller than its apertures to pass therethrough. Any treated materials larger than such apertures remains upon the crushing surface and is further exposed to the impacting forces of the crusher hammers. Projecting from either side of the grate bar are a series of integral extensions 12, such that when a series of grate bars are arranged side-by-side into the formation of the crushing surface, as at 3, these extended portions 12 of each adjacent grate bar from supplemental apertures, half of one as shown at 13, and which further function within the surface to augment the screening process of the materials being crushed. Each grate bar, or more particularly its extensions 12, is doubled contoured, as at 14 and 15, so that as the grate bars are abutted, one against the other, in the formation of a crusher surface 3 at least the upper edges of each extension 12 come into contiguous contact to provide adequate mating closure between adjacent bars to form a unified like crushing surface, as shown in FIG. 1. Likewise, in the event that any particular grate bar is reversed upside down in its positioning in the surface, then the contoured edges 15 come into contiguity with like edges upon the next adjacent bars so as to form a smoothly disposed crushing surface. Obviously, the contours 14 and 15 provided upon the lateral edges of each extension 12 of a grate bar are bevelled to that degree sufficient to conform to the curvature of the surface designed into the crusher.

Figure 6:
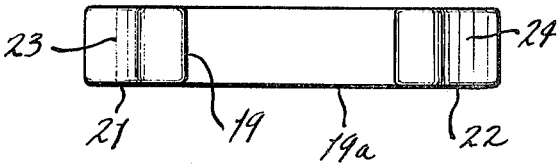
FIG. 6 provides a top view of an end shoe support, such as one them as shown in FIG. 2.
Figure 7:
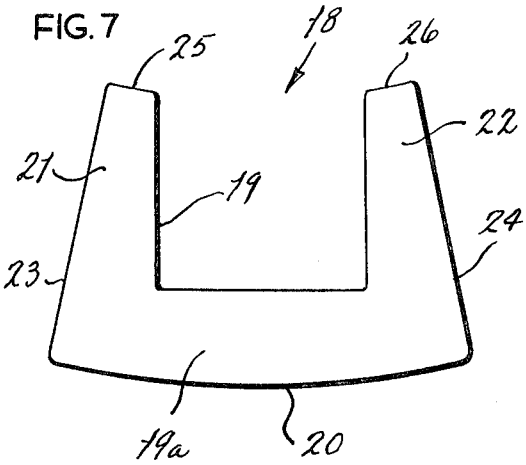
FIG. 7 provides an end view of the shoe of this invention.
Figure 8:
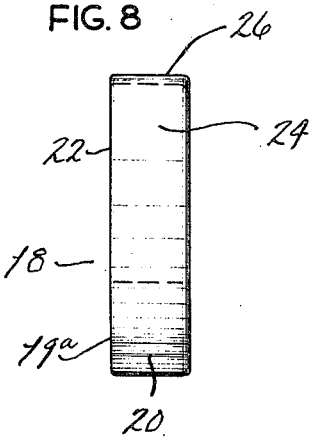
FIG. 8 provides a side view of the type of shoe shown in FIG. 7.

Further projecting integrally from each bar are its ends 16 and 17, with said ends having sufficient structural rigidity to provide for stable support of the grate bar within the supports and liners 5 and 6 provided along each side of the housing. The dimensions of these ends 16 and 17 are such as to provide for their insertion within a shoe like structure 18, one each provided for each end of the reversible grate bar. See also FIGS. 6 through 8. Each shoe 18 is provided with a structured base member 19*a* that is contoured, as at 20, and in this particular instance, along a curve so as to conform and mate upon the grate bar support 5 of the crusher. Projecting integrally upwardly from each side of the base member 19*a* are a pair of spacers 21 and 22 that conveniently provide for spacing between the adjacent grate bars as set within the crusher surface 3. Each of these spacers 21 and 22 are contoured along their edges, as shown respectively at 23 and 24, so that as each reversible grate bar is brought into an adjacent relationship with the next grate bar within the formation of the crushing surface, these contoured edges of the shoe likewise will enter into contiguity to provide convenient spacing between the grate bars and their proper arrangement into the formation of said surface. Each shoe 18 is provided with a slot, as at 19, therein, which slot has dimensions only slightly in excess of the dimensions of the bar ends 16 and 17, so that said ends can be conveniently inserted within the slot in preparation for insertion of a grate bar assembly into the mill.

It should also be noted that the upper surface of each spacer 21 and 22 of a shoe 18 may also be slightly contoured as at 25 and 26, so as to provide for its very close relationship with respect to the underside of the lower side liner 6 when a grate bar assembly is being inserted and maintained within the crushing surface.

Figure 9:
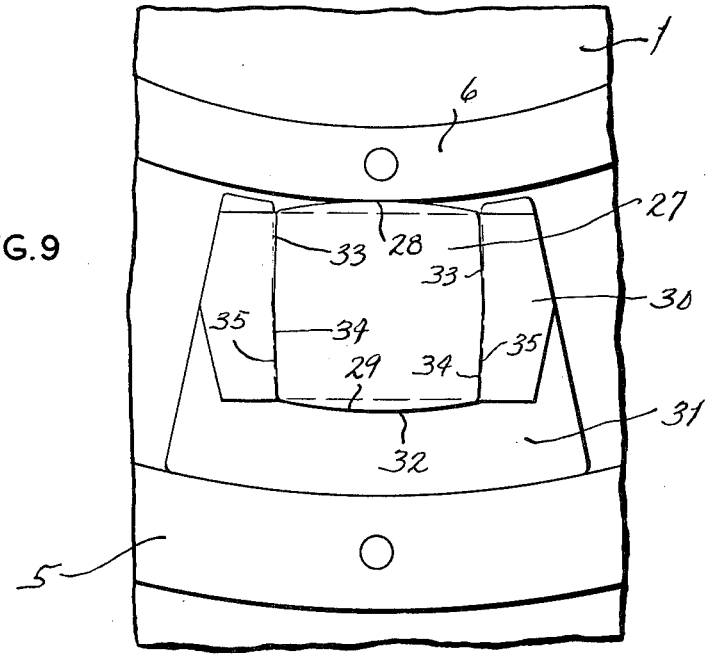
FIG. 9 shows a fragmentary view of the side of a crusher, and further displaying a modified end shoe and the end of a modified reversible grate bar intermediately spaced between the side supports of the crusher.
Figure 10:
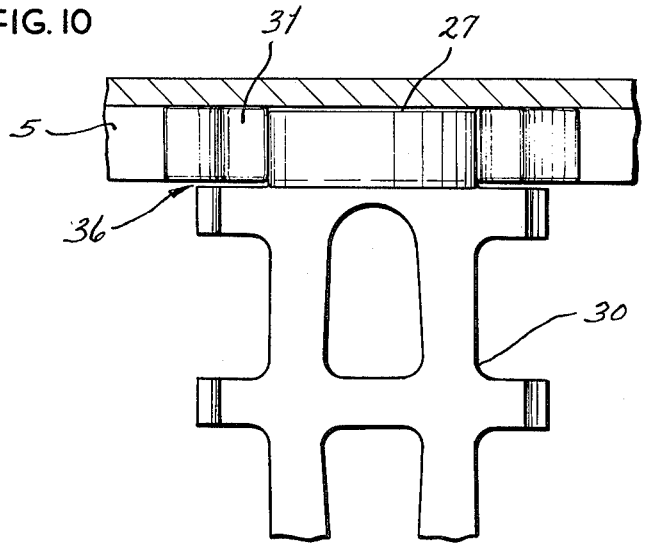
FIG. 10 provides a top view of the end shoe and part of the reversible grate bar in its setting as shown in FIG. 9.

In the structuring of a crushing surface it is desirable that such a surface be rigidly secured within the hammer mill. Any looseness in the surface can cause displacement or vibrations that can lead to an early deterioration of the members encountering the brunt of the crushing forces. Hence, as shown in FIGS. 9 and 10, there is disclosed a slight modification to the end members 27 of a grate bar, wherein each such member is provided with slight convexity upon both its upper surface 28 and its lower surface 29 so as to provide a contact relationship, or close thereto, of the grate bar 30 and its shoe 31 intermediate the bar support 5 and the lower side liner 6. As can be seen, the upper convexity 28 of the bar appears to be in contact with the lower edge of the liner 6, which means that the reversible grate bar assembly is secure between this support and liner, and prevented from any movement with respect thereto. Obviously the lower portion 32 of the slot formed within the shoe 31 is also formed having concavity complemental to the convexity provided upon the upper and lower surfaces of each end of the grate bar so that regardless of which side of the grate bar may be forming the upper surface of the crusher, the shoe will be able to accommodate the opposite convex portion of the bar end. Furthermore, and to further insure a mating and snug contact between the grate bar 30 and the shoe 31, the sides of the bar end 27 may also be formed having a double bevel or contour, as at 33 and 34, with the lower half of the slot likewise being contoured, as at 35, so as to accommodate in a close mating relationship the beveled sides of the end 27 of each grate bar. As can also be seen in FIG. 10, the length of the end 27 of each grate bar 30 is a distance approximating the width of its accompanying shoe 31, so as to provide for a surface that ends along its sides, as at 36, in close proximity with either the end shoes or the liner and support of the crusher. This effectively prevents the shoes from becoming dislodged and falling into the crusher.

The foregoing provides a description of what is considered the preferred embodiment of this invention, and its modifications as designed into the same. Other variations or changes upon this embodiment may be considered by those skilled in the art upon reviewing the subject matter of this application. Any such modifications or changes, if within the spirit and scope of the claims appended hereto, are also intended to be encompassed and protected by any patent issuing hereon.

Having thus described the invention what is claimed and desired to be secured by Letters Patent is:

1. In a reversible grate bar for a crusher of the type having side supports for holding the grate bar surface in place during crusher usage, each bar having a width approximating the distance between the sides of the crusher, a pair of removable shoes provided for embracing each end of the bar and adapted for securely confining the bar upon the said side supports of the crusher, and said grate bar being reversible and supportive within said shoes for thereby disposing either side of the grate bar in the formation of crusher surface.

2. The invention of claim 1 wherein there are a series of said reversible grate bars and accompanying pairs of removable end shoes in the formation of the crusher surface.

3. The invention of claim 2 wherein the crusher surface is arcuately arranged.

4. In the invention of claim 2 wherein each removable end shoe is formed having a slot therein with said slot being dimensioned to accommodate the end of a reversible grate bar therein.

5. In the invention of claim 4 wherein each removable end shoe is formed having a width approximating the depth of the crusher side supports.

6. In the invention of claim 4 wherein the sides of each end shoe are contoured to provide for their mating in adjacency when a series of the reversible grate bars and accompanying removable end shoes are arranged into the configuration of a crusher surface.

7. The invention of claim 6 wherein the lower surface of each removable end shoe is contoured along a radius corresponding to its supportive position within the curved arrangement of the side supports structured into the formation of the crusher.

8. In the invention of claim 4 wherein both the sides of the end shoe slot and the contiguous reversible grate bar are partially tapered to provide for a secure retention of these components together during the crusher surface assembly.

9. The invention of claim 2 wherein each reversible grate bar is formed having aperture forming structure provided therein, the sides of each grate bar being contoured to provide for their complemental locating against adjacent bars when arranged into the formation of a crusher surface.

10. The invention of claim 9 wherein each grate bar side is double contoured to provide for their complemental fitting together in adjacency regardless of which surface the bar is arranged into the assembly of the crusher surface.

11. In a hammer mill incorporating a rotating crusher and a crushing surface comprising a housing having opposed side walls and inlet and discharge openings, each side wall having arcuately arranged side supports designed for accommodating in a supportive relationship said crushing surface, the side supports comprising a lower support and a lower said liner spaced apart a distance to accommodate the ends of the crushing surface intermediate thereof, said crushing surface formed from a series of adjacently arranged reversible grate bars, and a pair of removable shoes provided for embracing each end of a bar and adapted for securely confining the same intermediate the lower support and the lower side liner of the side supports.

12. In the invention of claim 11 wherein each grate bar and its removable end embracing shoes are contoured on their sides to provide for their mating with adjacent respective bars and shoes when arranged into the formation of a crushing surface.

13. The invention of claim 11 wherein each removable shoe is formed having a base portion for stabilizing the grate bar upon the side support of the mill, and a pair of spacers extending integrally upwardly from each side of said base portion for providing structured fixed positioning between a series of the grate bars assembled into the crusher surface.

14. A series of reversible grate bars for a crusher of the type having side supports for holding the grate bar surfaces in place during crusher usuage, each grate bar having a width approximating the distance between the sides of the crusher, a pair of removable shoes provided for embracing each end of a bar of the said series of grate bars with said shoes adapted for securely confining the bar upon the said side supports of the crusher, each end shoe being formed having a slot therein with said slot being dimensioned to accommodate the end of one of said reversible grate bars therein, the portion of each reversible grate bar that inserts within an end shoe formed having upper and lower convex surfaces, each shoe slot being formed having a lower concaved surface provided for accommodating the contiguous convex surface of an inserted grate bar, the upper convex surface of each grate bar designed for furnishing confined emplacement of the grate bar intermediate the crusher side supports, with each grate bar of the series of grate bars being reversible and supportive within said shoes for thereby disposing either side of the said grate bars in the formation of a crusher surface.

* * * * *